US008173924B2

(12) United States Patent
Tegel et al.

(10) Patent No.: US 8,173,924 B2
(45) Date of Patent: May 8, 2012

(54) DUAL FUNCTION SWITCH ASSEMBLY

(75) Inventors: Robert G. Tegel, Glenview, IL (US); Robert Dam, Glenview, IL (US); Michael W. Hartley, Glenview, IL (US); Richard D. Gjerde, Glenview, IL (US); Richard R. Herzog, Glenview, IL (US); David R. Nowak, Glenview, IL (US); Ronald R. Hostert, Glenview, IL (US); Theodore James John Veselsky, Glenview, IL (US); Juan J. Barrena, Glenview, IL (US)

(73) Assignee: Illinois Tool Works Inc., Glenview, IL (US)

( * ) Notice: Subject to any disclaimer, the term of this patent is extended or adjusted under 35 U.S.C. 154(b) by 491 days.

(21) Appl. No.: 12/294,332

(22) PCT Filed: Jun. 25, 2007

(86) PCT No.: PCT/US2007/072005

§ 371 (c)(1),
(2), (4) Date: Mar. 20, 2009

(87) PCT Pub. No.: WO2008/002863

PCT Pub. Date: Jan. 3, 2008

(65) Prior Publication Data

US 2009/0321231 A1 Dec. 31, 2009

Related U.S. Application Data

(60) Provisional application No. 60/816,544, filed on Jun. 26, 2006.

(51) Int. Cl.
*H01H 19/62* (2006.01)
*H01H 9/06* (2006.01)

(52) U.S. Cl. ..... 200/569; 200/564; 200/568; 200/61.86; 200/6 B; 200/6 BB

(58) Field of Classification Search ..... 200/11 R–11 K, 200/6 R–6 C, 16 R–16 D, 61.85, 61.86, 564–569, 200/336
See application file for complete search history.

(56) References Cited

U.S. PATENT DOCUMENTS

| | | | | | |
|---|---|---|---|---|---|
| 3,860,786 | A | * | 1/1975 | Wass | 392/307 |
| 3,971,904 | A | * | 7/1976 | Ward | 200/6 BB |
| 4,019,855 | A | * | 4/1977 | Camillo | 431/256 |
| 4,177,367 | A | | 12/1979 | Tirone et al. | |
| 4,258,349 | A | | 3/1981 | Flory | |
| 4,272,658 | A | | 6/1981 | Crosby | |
| 4,308,433 | A | * | 12/1981 | Edwards, Jr. | 200/5 R |
| 4,493,953 | A | * | 1/1985 | Bound | 200/6 B |
| 4,495,387 | A | * | 1/1985 | Thrush | 200/6 B |
| 4,612,423 | A | * | 9/1986 | Munroe | 200/16 R |
| 4,861,949 | A | * | 8/1989 | Bortolloni et al. | 200/5 R |

(Continued)

OTHER PUBLICATIONS

ISR for PCT/US2007/72005 dated Feb. 25, 2008.

*Primary Examiner* — Michael Friedhofer
(74) *Attorney, Agent, or Firm* — Lowe Hauptman Ham & Berner LLP

(57) ABSTRACT

A dual function switch assembly includes a switch housing part containing multiple switches at different elevations and a rotor having cam surfaces aligned with the switches for operating the switches. A mounting part is connected to the switch housing part and provides mounting features for attachment in a desired installation.

20 Claims, 7 Drawing Sheets

U.S. PATENT DOCUMENTS 4,894,019 A 1/1990 Howard
5,650,601 A * 7/1997 Krueger et al. ..... 200/61.86
5,687,836 A * 11/1997 Gjerde ..... 200/569
6,077,126 A 6/2000 Peng
6,096,987 A * 8/2000 Krueger et al. ..... 200/61.86
6,130,389 A * 10/2000 Rao ..... 200/296
7,148,440 B2 * 12/2006 Gjerde ..... 200/569
2004/0201274 A1 10/2004 Rudolph et al.
2006/0042925 A1 3/2006 Gjerde

* cited by examiner

DUAL FUNCTION SWITCH ASSEMBLY

CROSS-REFERENCE TO RELATED APPLICATIONS

The present regular United States patent application claims the benefits of U.S. Provisional Application Ser. No. 60/816,544, filed on Jun. 26, 2006.

FIELD OF THE INVENTION

The present invention relates generally to electrical switch assemblies that are actuated by rotatable members, and, more particularly the invention pertains to switches used in wiring harnesses such as on appliances, including ignition systems for gas fired appliances, outdoor cooking equipment and the like.

BACKGROUND OF THE INVENTION

Electrical switches having rotatable actuators are used in a variety of applications. For example, it is known to use such switches in gas fueled cooking appliances. An electrical switch assembly is coupled to the rotatable valve stem of the gas valve, to control burner ignition circuitry. When the gas valve stem is rotated to place the valve in the open position and commence gas flow, the burner ignition electrical circuitry is energized to ignite the gas stream at the burner. In this way, stand-by pilot lights are not required, and gas ignition occurs simultaneously with opening the gas valve and commencing the flow of gas. Fuel is not wasted keeping a pilot light burning. Considerable fuel savings can be experienced, particularly in appliances that are used infrequently, with prolonged periods of nonuse. Pilot-less ignition systems conserve fuel and thereby improve appliance efficiency.

U.S. Pat. No. 5,687,836 entitled "ELECTRICAL SWITCH ASSEMBLY ACTUATABLE BY A ROTATABLE MEMBER", issued Nov. 18, 1997, describes one such electrical switch assembly having utility for gas appliances. While providing many advantages, the switch assembly disclosed therein can be used only for a single circuit, and each switch function in each circuit requires a separate switch.

To improve appliance safety and enhance customer convenience, it is sometimes desirable to include multiple switching functions upon actuation or rotation of a single actuator. A variety of indicator lights to indicate status may be actuated with the primary function, or may be oppositely actuated. For example, it may be desirable to illuminate a "burner on" indicator together with actuation of the ignition circuitry when a gas valve is opened. An electric circuit to indicate ignition failure can be energized upon opening the gas valve, to be illuminated if ignition does not occur within a specific period of time. It may be desirable for various other safety and/or convenience features that are electrically operated to be actuated or de-actuated upon opening the gas valve.

As more and more individual switches for additional functions are combined with a single actuator, the actuator becomes unduly long and complex. Individual switches can be electrically connected, one to another, with only one controlled by the actuator, and others electrically controlled therefrom. However the wiring harness becomes unduly large and complex, and requires significant space for installation. In appliances, it is desirable to minimize space requirements for controls and the like, to maximize area available for appliance functions, for example oven interior space, while minimizing overall appliance size.

U.S. Pat. No. 7,148,440 entitled "STACKABLE SWITCH" issued Dec. 12, 2006, describes a multi-function switch of one type in which multiple switch functions can be stacked one upon another using an intermediate housing member having surface topographies suitable for use in the switches on opposite sides thereof. While the stackable switch disclosed therein provides multi-switching functions in a more compact arrangement than utilizing separate individual switches, in some applications still lower profiles are desirable. For example, to maintain adequate air flow around gas valves associated with the switches, still lower profiles are desirable to minimize the housing and structural dimensions required to contain the gas valves, gas supply systems and wire harnesses.

SUMMARY OF THE INVENTION

The present invention provides a dual function switch assembly having first and second switches contained in a single housing, and a single rotor having peripheral profiles for operating each switch upon rotation of the rotor.

In one aspect thereof, the present invention provides a multifunction switch assembly with a switch housing part having a base, first and second switches disposed in the switch housing part at different relative elevations with respect to the base and a switch actuating rotor having first and second peripheral profiles aligned with the first and second switches, respectively. A mounting part overlies the first and second switches and has an outward feature for attaching the switch assembly in an installation. The switch mounting part and the switch housing part are adapted for engagement one with the other.

In another aspect thereof, the present invention provides a switch assembly with a first switch part containing contacts therein for first and second switches and a rotor for actuating the switches. The rotor has first and second circumferential profile portions aligned with the first and second switches, respectively. A second switch part overlies the first switch part and includes connecting features for mounting the switch assembly in an installation.

In a still further aspect thereof, the present invention provides a wire harness with first, second, third and fourth conductors and a switch assembly having a first switch therein electrically connected to the first and second conductors, a second switch therein electrically connected to the third and fourth conductors; and a rotor disposed between the first and second switches and including first and second circumferential profiles aligned with the first and second switches, respectively. The third and fourth conductors are stacked on the first and second conductors, respectively.

An advantage of the present invention, in one form thereof, is providing a multi-function, multi-switch arrangement that is compact.

Another advantage of the present invention, in another form thereof, is providing multiple switches actuated by a single actuator.

Still another advantage of the present invention, in still another form thereof, is providing multiple switches that require minimal space.

Yet another advantage of the present invention, in yet another form thereof, is providing a multi-function switch assembly in which the switch components can be pre-assembled in one portion of the overall assembly that is common to multiple variations of the assembly and thereafter coupled with another portion of the overall assembly that is unique to final uses for the assembly.

Other features and advantages of the invention will become apparent to those skilled in the art upon review of the following detailed description, claims and drawings in which like numerals are used to designate like features.

Figure 1:
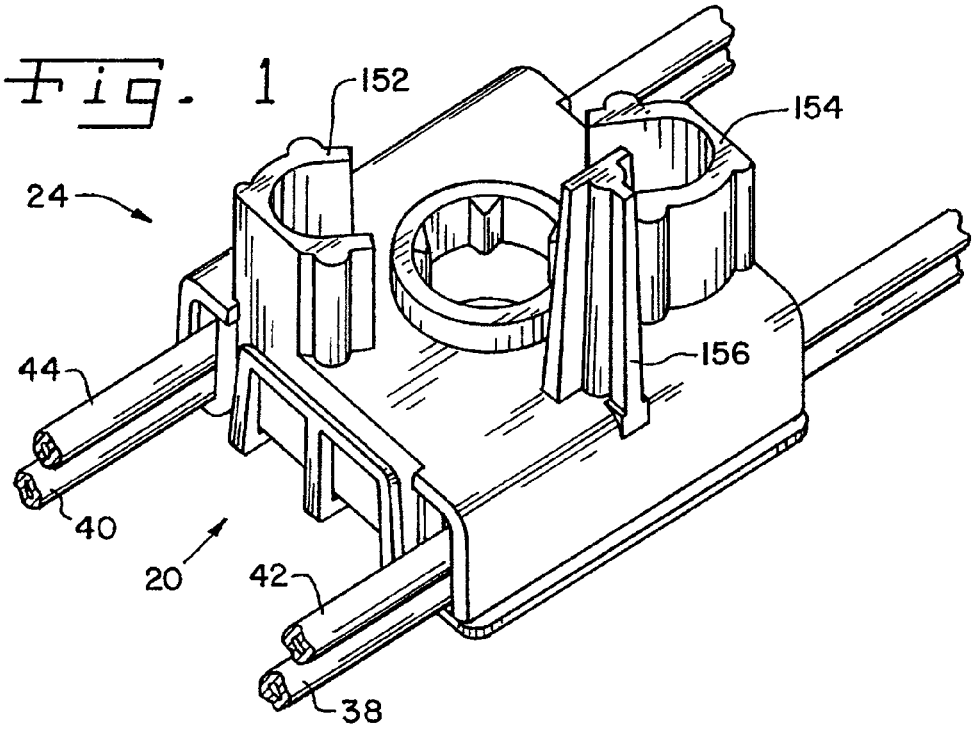
FIG. 1 is a perspective view of a dual function switch assembly in accordance with the present invention, illustrating the switch assembly installed in a fragmentary portion of a wire harness.

Before the embodiments of the invention are explained in detail, it is to be understood that the invention is not limited in its application to the details of construction and the arrangements of the components set forth in the following description or illustrated in the drawings: The invention is capable of other embodiments and of being practiced or being carried out in various ways. Also, it is understood that the phraseology and terminology used herein are for the purpose of description and should not be regarded as limiting. The use herein of "including", "comprising" and variations thereof is meant to encompass the items listed thereafter and equivalents thereof, as well as additional items and equivalents thereof.

DETAILED DESCRIPTION OF THE PREFERRED EMBODIMENT

Figure 14:
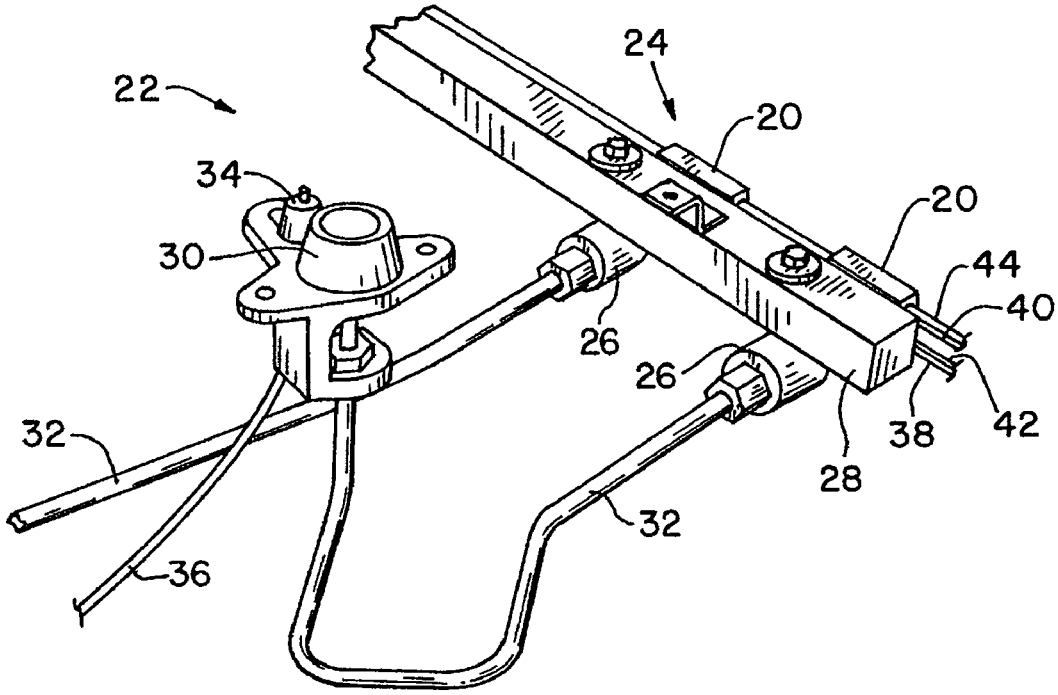
FIG. 14 is a fragmentary perspective view of a gas appliance having switch assemblies of the present invention.

Referring now more specifically to the drawings and to FIG. 14 in particular, two dual function switch assemblies 20 of the present invention are shown installed in a gas fired appliance 22. Dual function switch assemblies 20 are electrically connected in a wire harness 24 and are operatively associated with gas valves 26. Each gas valve 26 initiates, controls and terminates gas flow from a gas manifold 28 to burner assemblies 30, one such burner assembly 30 for one gas valve 26 being illustrated in FIG. 14. Gas valves 26 control flow of gaseous fuel from manifold 28 to burner assemblies 30 via gas supply lines 32. Gas flow at burner assemblies 30 is ignited by an electronic igniter 34 provided as part of each burner assembly 30. A signal line 36 to each burner assembly electronic igniter 34 is operatively and electrically connected to wire harness 24 through an electronic ignition module (not shown) such that ignition signals are sent upon the opening of gas valves 26 and the simultaneous operation of switches 20 thereby.

While two switch assemblies 20 are illustrated on wire harness 24 in FIG. 14, those skilled in the art will readily understand that a single switch assembly 20 may be used where appropriate, and three or more switch assemblies 20 may be used as part of wire harness 24 when required. The present invention works well with a variety of actuators such as gas valves 26 in appliances such as kitchen ranges, outdoor grills and the like. However, it is expected that switch assemblies 20 of the present invention will have other suitable uses as well.

Wire harness 24 includes a plurality of electrical conductors 38, 40, 42 and 44 connected to switch assemblies 20 as will be described in greater detail hereinafter. An electronic ignition module (not shown) and other suitable control devices are provided as part of appliance 22 between wire harness 24 and signal line 36. The design, installation and operation of such devices and gas flow equipment are well-known to those skilled in the art and will not be described in further detail herein.

Figure 2:
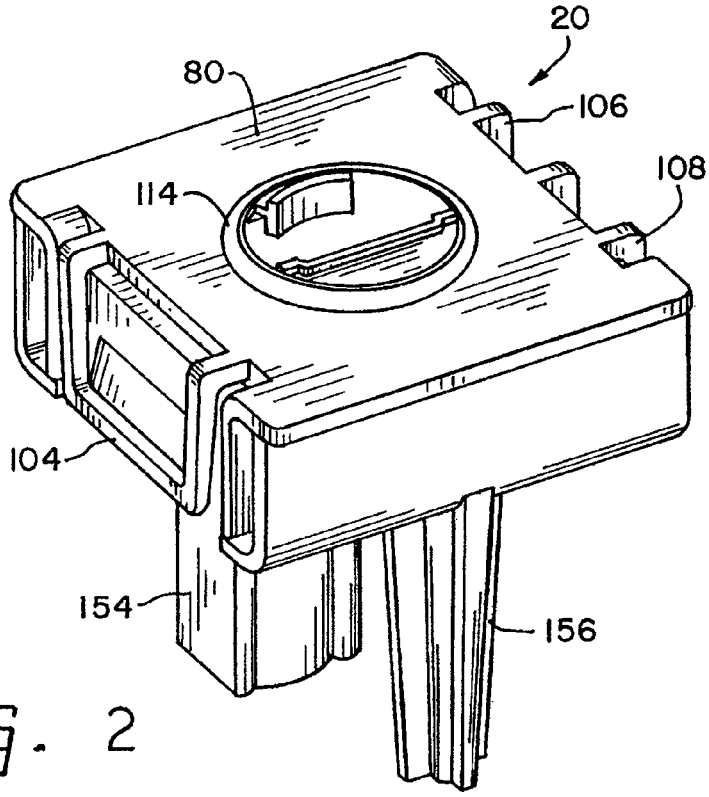
FIG. 2 is a perspective view of only the switch assembly shown in FIG. 1, illustrating the side opposite the side shown in FIG. 1.
Figure 9:
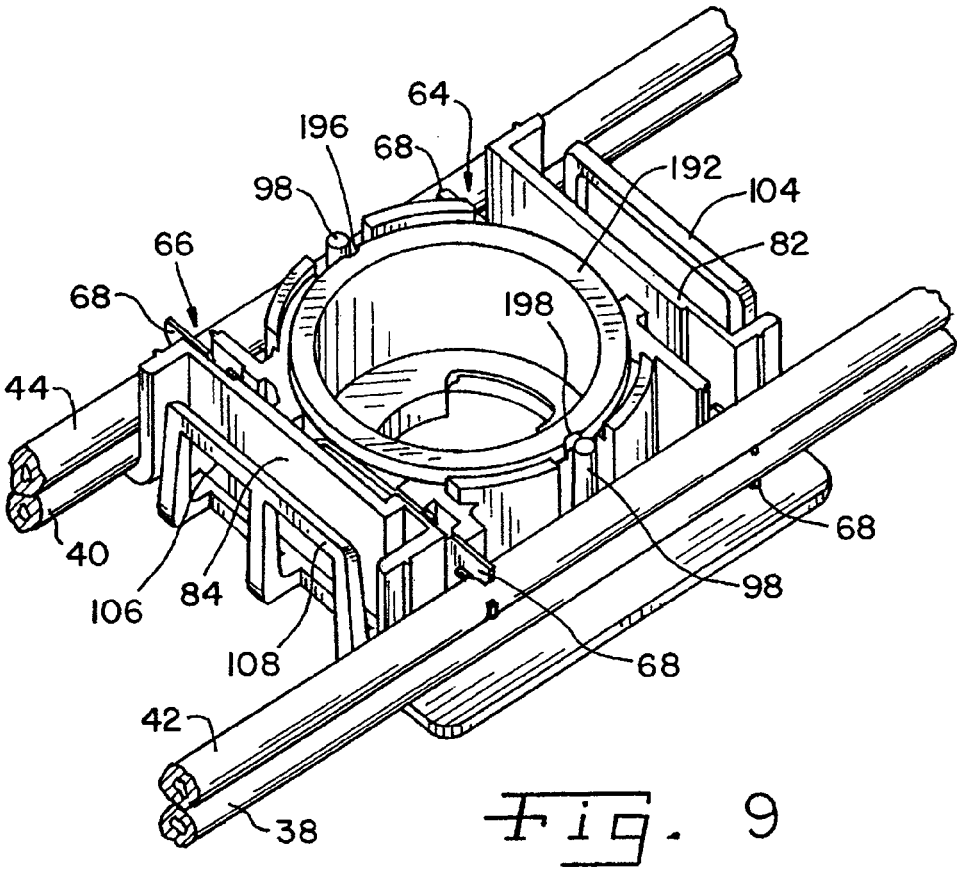
FIG. 9 is a perspective view of the switch assembly and wire harness fragmentary portion shown in FIG. 1, with a portion of the switch assembly removed.
Figure 10:
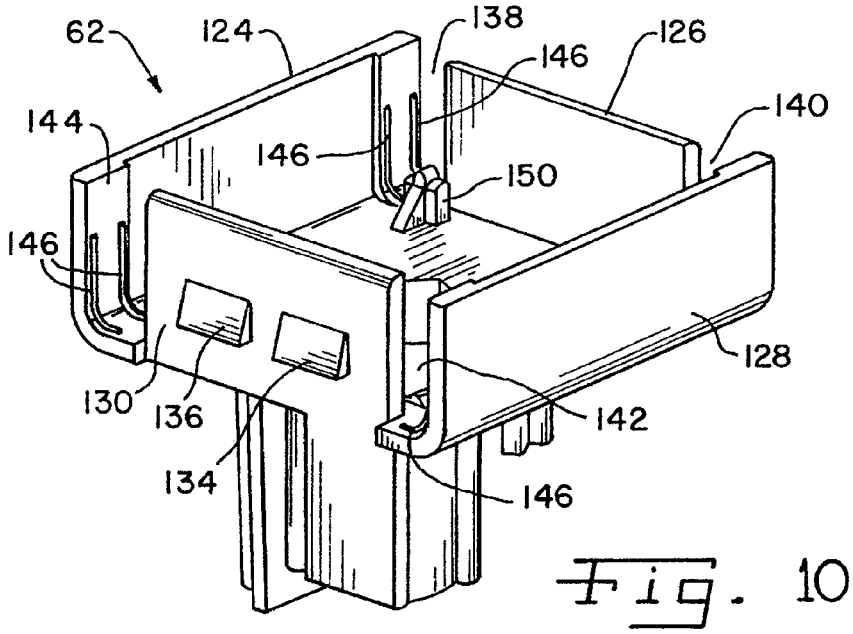
FIG. 10 is a perspective view of a mounting part of the switch assembly of the present invention, the part being shown in FIG. 1 but removed in FIG. 9.
Figure 11:
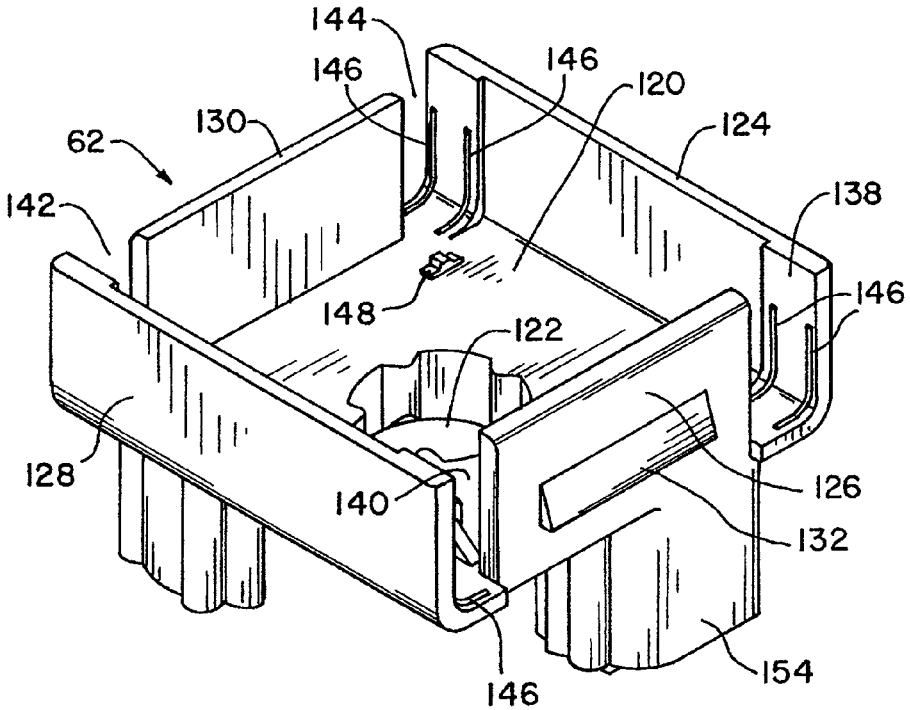
FIG. 11 is a perspective view of the mounting part shown in FIG. 10, but shown from a different angle.

With reference now to FIGS. 1-13, a dual function switch assembly 20 (FIGS. 1 and 2) of the present invention will be described in greater detail. Dual function switch assembly 20 includes a switch housing part 60 (FIGS. 3 and 4) mechanically connected to a mounting part 62 (FIGS. 10 and 11).

Switch housing part 60 contains first and second switches 64, 66, respectively. Each switch 64, 66 has two similar switch contacts 68 illustrated in FIGS. 5, 6 and 7. Each contact 68 includes an elongated, substantially flat body 70 having a hooked end 72 at one end thereof and an insulation displacing contact slot 74 at the opposite end thereof. A feature of one preferred form of the present invention is the laterally outwardly opening, axially oriented insulation displacing contact slot 74 for engaging conductors inserted from the end thereof. Contact 68 further includes locating features such as cutouts 76 and/or projections 78 for engaging complementary locating features of switch housing part 60. Further, contact body 70 can have dimples or the like provided at locations along the length thereof for improving rigidity of contact 68 while maintaining overall thin and narrow profiles therefore.

Figure 6:
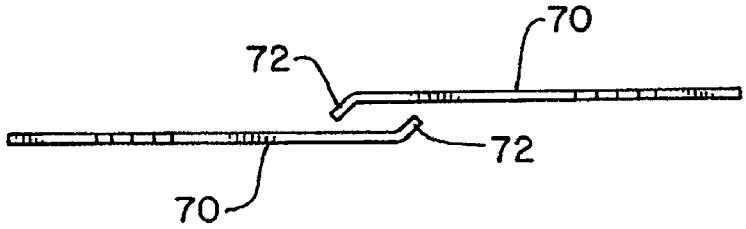
FIG. 6 is an elevational view of a pair of switch contacts forming a switch for the switch assembly in accordance with the present invention, illustrating the contacts in an open condition.
Figure 7:
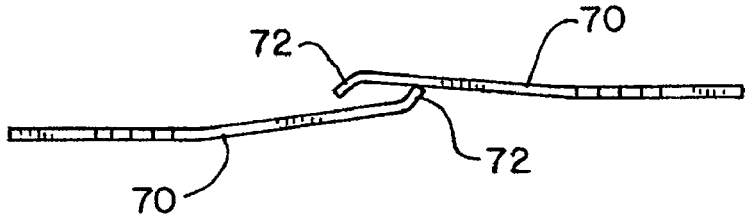
FIG. 7 is an elevational view of the switch contacts shown in FIG. 6, but illustrating the contacts in a closed condition.
Figure 8:
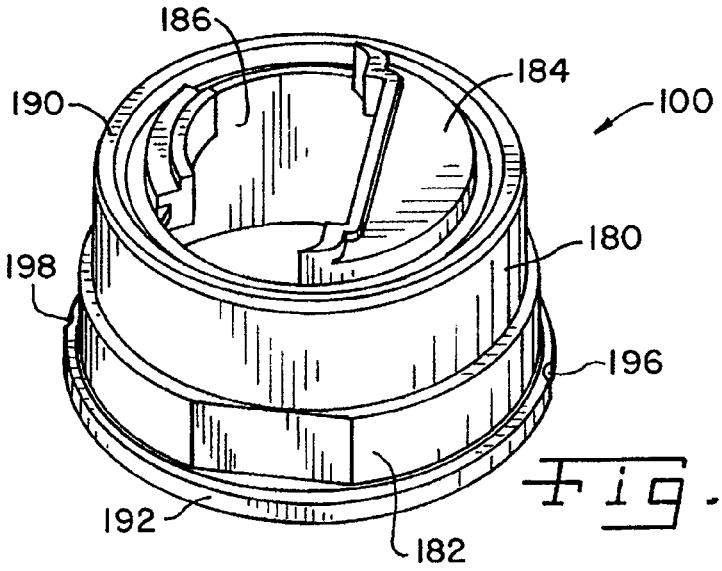
FIG. 8 is a perspective view of a rotor for the switch assembly shown in the previous drawings.

As shown in FIG. 6, a pair of contacts 68 are provided in overlying arrangement for each switch 64, 66. In the open condition shown in FIG. 6, contacts 68 are spaced one from the other. In a closed condition illustrated in FIG. 7, contacts 68 are touching. Engagement of one contact 68 against the other contact 68 is by the edge of hooked end 72. As one contact 68 is deflected toward the other contact 68, a swiping motion is actuated by one hooked end 72 against body 70 of the other contact 68. The swiping motion of the end edge of hooked end 72 provides a self-cleaning feature for the area of electrical connection.

A beneficial feature of preferred forms of the present invention is the use of symmetrical contacts 68 so that each contact 68 in each switch 64, 66 is the same as the other contacts of switch assembly 20. Therefore, assembly is facilitated in that all contacts are interchangeable, and the installer need not identify specific contacts for specific positions. Mechanical, automated assembly is also facilitated by the use of interchangeable contacts at all positions.

Switch housing part 60 includes a base 80, opposed side panels 82, 84 and central formations 86, 88, 90 and 92. Each central formation 86, 88, 90 and 92 includes a generally flat wall segment 94 and a curved barrier segment 96. Wall segments 94 of each formation 86, 88, 90 and 92 confront one or the other of opposed side panels 82, 84 in spaced relation. Contacts 68 in pairs for each switch 64, 66 are restrained between sides 82, 84 respectively, and the wall segments 94 confronting it.

Figure 3:
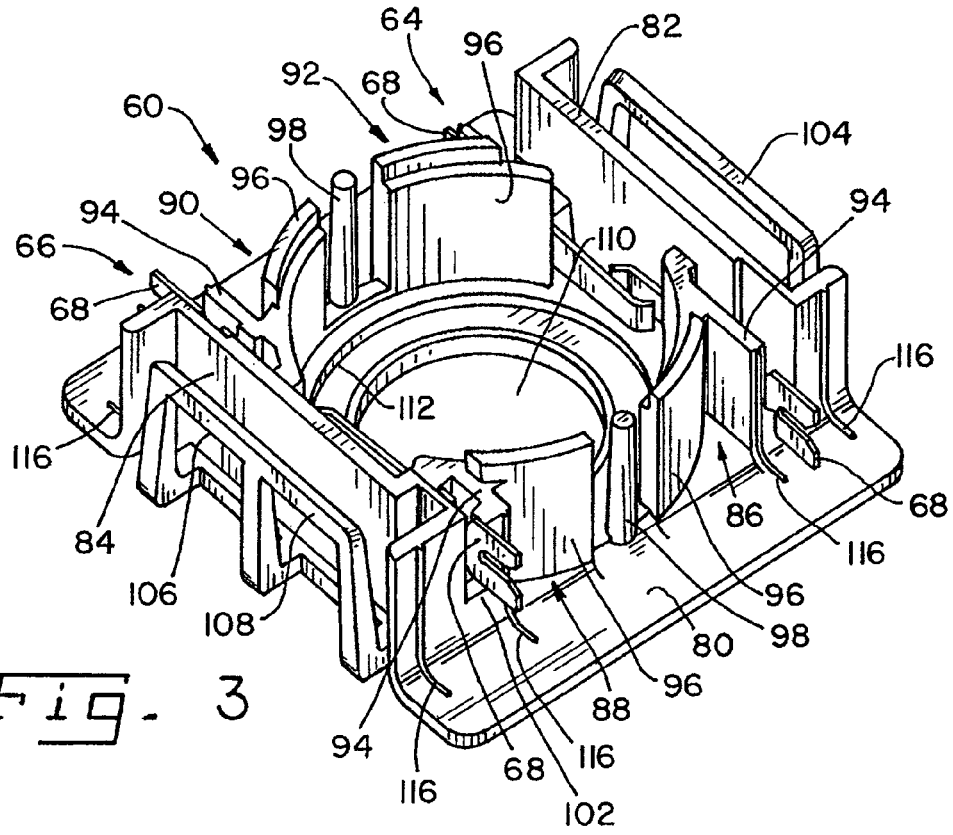
FIG. 3 is a perspective view of a switch housing part of the switch assembly shown in FIGS. 1 and 2.
Figure 4:
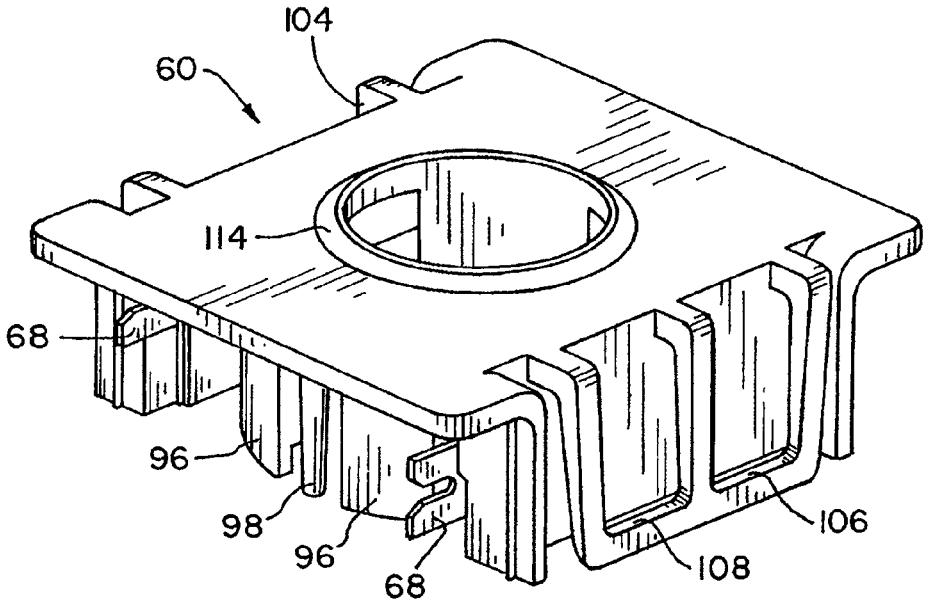
FIG. 4 is a perspective view of the switch housing part shown in FIG. 3, illustrating the side opposite the side shown in FIG. 3.
Figure 5:
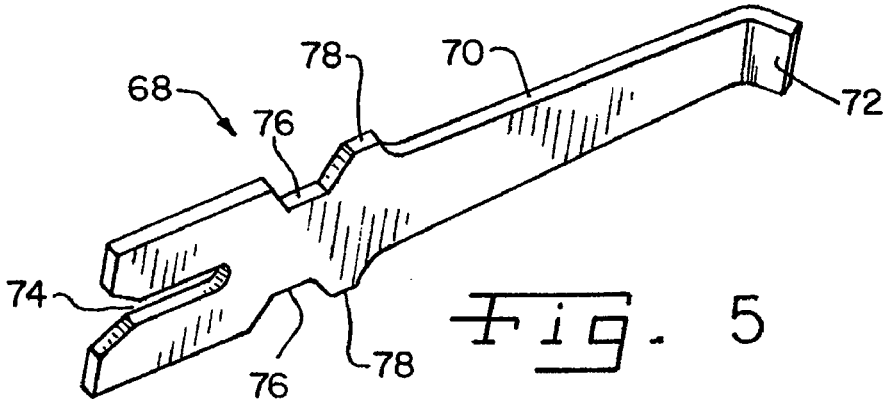
FIG. 5 is a perspective view of a switch contact for the switch assembly shown in the preceding drawings.

Along one or both of the opposite sides of base 80 between side panels 82, 84 a pedestal 98 is provided between adjacent curved barrier segments 94, one pedestal 98 at each of the sides being shown in FIG. 3. Curved barrier segments 94 are arranged to define a space for receiving a rotor 100 therebetween, rotation of which operates first and second switches 64, 66 as will be described in greater detail hereinafter.

The pairs of contacts 68 defining first switch 64 and second switch 66 are disposed at different elevations relative to base 80, with second switch 66 elevated from base 80 by locating features 102. Thus, as can be seen most clearly in FIGS. 3 and 9, contacts 68 of first switch 64 are disposed substantially against base 80 while contacts 68 of second switch 66 are elevated with respect to base 80. Conductors 38, 40, 42 and 44 pass through switch housing part 60 in pairs on opposite sides. On each side, the conductors are stacked one on top of another. Accordingly, conductors 38 and 40 are provided against base 80 along opposite sides, with each connected to a different one of the contacts 68 in first switch 64. Conductors 42 and 44 are provided stacked on top of conductors 38 and 40, respectively, with each electrically connected to a different one of the contacts 68 in second switch 66. Accordingly, contacts 68 of second switch 66 are elevated from base 80 by a dimension approximately equal to the diameters of conductors 38 and 40. The end opening insulation displacing contact slot 74 in each contact 68 facilitates orderly, compact electrical connection of conductors 38, 40, 42 and 44 to the contacts, with the conductors stacked one on another in pairs along the ends of the contacts.

On one side edge of base 80 a single latch loop 104 is provided and along an opposite side edge of base 80 two latch loops 106, 108 are provided for mechanical engagement with mounting part 62 to secure switch housing part 60 and mounting part 62 one to the other, as will be described in greater detail hereinafter.

Base 80 defines an aperture 110 therein substantially centrally located between barrier segments 96. On an inner surface of base 80, an annular channel 112 defines a path for rotation of rotor 100. On an outer surface of base 80 an outwardly projecting rim 114 surrounds aperture 110 for redirecting moisture and liquids away from aperture 110, to inhibit migration of liquids into switch assembly 20. Within switch assembly 20, wall segments 94 and barrier segments 96 block and redirect moisture away from contacts 68.

Along opposed sides of base 80, adjacent the ends of contacts 68, base 80 defines generally L-shaped passages along which conductors 38, 40, 42 and 44 are positioned. Within the L-shaped passages, one or more ridge 116 is provided to frictionally engage the insulation of conductors 38, 40, 42 and 44 which extend thereover. Ridges 116 pinch against the conductors and provide strain relief if wire harness 24 is lifted, moved or stored by grasping one or more of the conductors 38, 40, 42 or 44. Strain relief ridges provide some frictional engagement against each of the conductors, to retain the relative positions of conductors 38, 40, 42 and 44 with respect to switch assembly 20. Ridges 116 also serve as barriers to the infiltration of liquids and other contaminants.

Referring now more particularly to FIGS. 10 and 11, mounting part 62 includes a base 120 defining a substantially flat, substantially unobstructed body having a central aperture 122 therein for receiving a valve stem therethrough. At the periphery of base 120, skirts 124, 126, 128 and 130 are provided. Skirt 126 includes an elongated single protrusion 132 and opposed skirt 130 includes two protrusions 134, 136. Single protrusion 132 and double protrusions 134, 136 are positioned and sized for engagement with single latch loop 104 and double latch loops 106, 108, respectively from switch housing part 60.

Skirts 124, 126, 128 and 130 are spaced one from another to define openings through which conductors 38, 40, 42 and 44 can pass in stacked arrangement. Thus, an opening 138 is provided between skirts 124 and 126. Similar openings 140, 142 and 144 are provided between, respectively, skirts 126 and 128, 128 and 130, and 130 and 124. Within openings 138, 140, 142 and 144 and along surfaces of base 120 and skirts 124, 126, 128 and 130, one or more ridge 146 is provided to frictionally engage the insulation of conductors 38, 40, 42 and 44 extended there over, to pinch against the conductors and provide strain relief if wire harness 24 or is lifted, moved or stored by grasping one or more of the conductors 38, 40, 42 or 44. Strain relief ridges provide some frictional engagement against each of the conductors to retain the relative positions of conductors 38, 40, 42 and 44 with respect to switch assembly 20. Ridges 146 also serve as a barriers to the infiltration of liquids and other contaminants.

Base 120 further defines one or more locating feature 148, 150 for positioning mounting part 62 relative to switch housing part 60 and/or for positioning conductors 38, 40, 42 and 44 relative to conductor openings 138, 140, 142 and 144, and/or for securing contacts 68 in position within an assembled switch assembly 20.

On an outer surface of mounting part 62, one or more pedestal or connecting fixture 152, 154, 156 is provided for engagement with gas valve 26, manifold 28 or other frame and housing components in which dual function switch assembly 20 is located. An advantageous feature of the present invention is that mounting part 62 contains none of the components or elements necessary for operation of switches 64, 66, all of which can be preinstalled in switch housing part 60 instead. Accordingly, mounting part 62 can be readily designed and manufactured for mating with particular components on which switch assembly 20 will be installed, while the more complex structure of switch housing part 60 remains standard for multiple installations.

Figure 15:
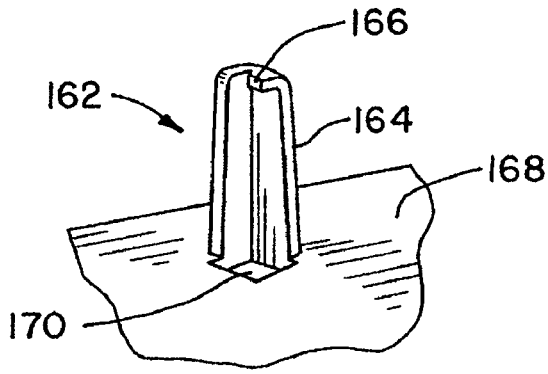
FIG. 15 is a fragmentary perspective view of a mounting part of another embodiment of the present invention.

Base 120, skirts 124, 126, 128 and 130 can be modified as necessary for ease and convenience in molding and assembly. For example, FIG. 15 illustrates a mounting part 162 defining a leg 164 having a hook or outcropping 166 and an end thereof. A base 168 of mounting part 162 defines a hole 170 through which a retractable mold pin (not shown) can be inserted for shaping leg 164 and hooked end 166. Other slots, apertures, openings or the like can be provided as necessary and/or convenient for designing and using a mold to form the necessary parts and components of mounting part 62, for adaptation to the particular gas valve and/or frame in which it is installed.

Rotor 100 is the actuator for first and second switches 64, 66 to operate the switches between closed and opened conditions depending on the rotational position of rotor 100 with respect to each switch 64, 66. Rotor 100 is a generally cylindrically shaped body having first and second circumferential outer cam surfaces 180, 182, respectively. An end body 184 has a non-circular opening 186 therethrough for receiving a noncircular portion of a valve stem 188 from gas valve 26. An end edge 190 of rotor 100 is configured to ride within channel 112. First cam surface 180 is aligned with first switch 64, and second cam surface 182 is aligned with second switch 66 such that one contact 68 of each contact pair in switches 64, 66 may ride against cam surfaces 180, 182, respectively. Rotation of stem 188 causes simultaneous rotation of rotor 100 and movement of first and second cam surfaces 180, 182 along first and second switches 64, 66. Accordingly, the peripheral surface shape of cam surfaces 180, 182 operates switches 64, 66 upon rotation of rotor 100 via rotation of valve stem 188.

On an end of rotor 100 opposite from end body 184, a flange 192 is provided with notches 196, 198. In the assembled configuration, pedestals 98 are received in notches 196, 198 to prevent unintended rotation of rotor 100. Accordingly, during transport, manipulation and installation the relative positioning of rotor 100 with respect to switch housing part 60 and mounting part 62 can be maintained to facilitate installation on gas valves 26. Providing a pedestal 98 in each notch 196, 198 enhances fixed, balanced positioning of rotor 100. Other types of rotation inhibiting structures also can be used.

Figure 12:
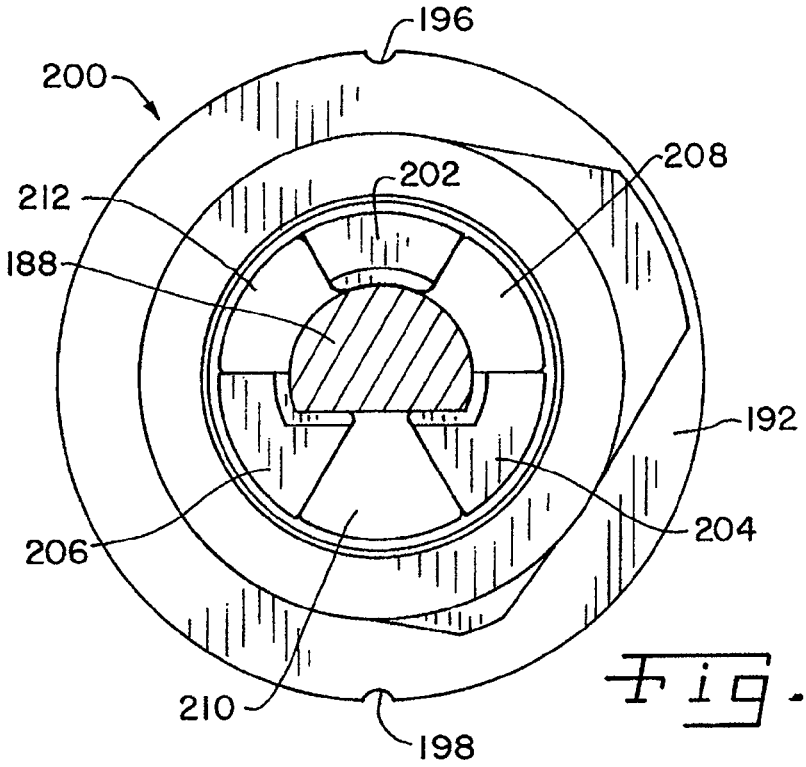
FIG. 12 is a cross-sectional view of a rotor installed on a valve stem.
Figure 13:
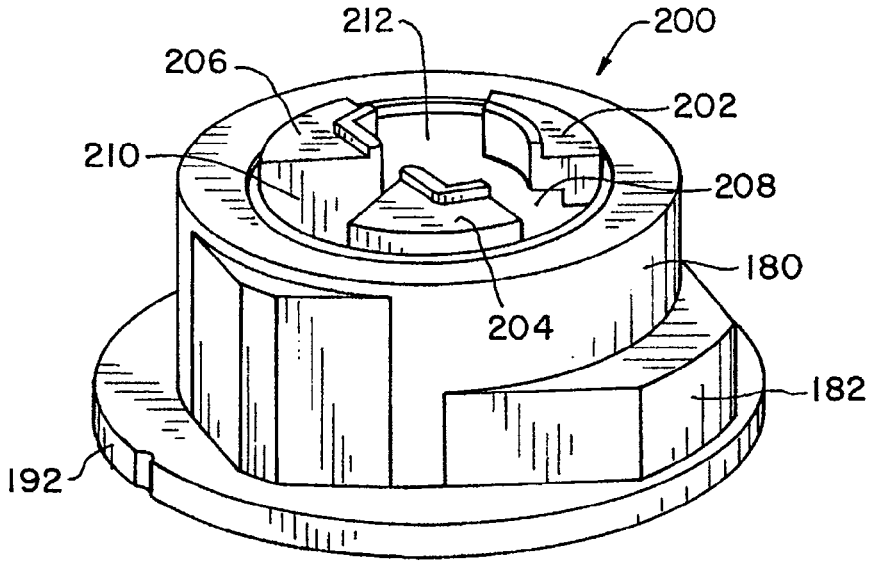
FIG. 13 is a perspective view of another embodiment of a rotor for a switch assembly in accordance with the present invention.

A rotor of the present invention can have numerous configurations for operating switches 64, 66. As illustrated in FIGS. 12 and 13, rotor 200 includes central bodies 202, 204, 206 for receiving shaft 188 while providing open channels 208, 210, 212 extending axially through rotor 200. Any fluids migrating into rotor 200 can drain effectively therefrom without unduly hindering operation of the switch via an open passage defined through the switch including aperture 110, aperture 122 and channels 208, 210 and 212.

For mold design simplicity and manufacturing efficiency, flange 192 can be as wide as or wider than all portions of second cam surface 182, which is at all points thereof as wide as or wider than all portions of first cam surface 180. By providing no blind setbacks, mold design is simplified.

Switch housing part 60, mounting part 62 and rotor 100 can be made from suitable plastic materials. Contacts 68 are desirably thin and narrow, to provide an overall assembly that is small. Suitable materials for contact 68 include beryllium-copper, phosphor-bronze and stainless steel. Other conductive materials with suitable mechanical properties also can be used.

In the assembly of switch assembly 20, a different contact 68 is connected to each of conductors 38, 40, 42, 44. Two of the contacts 68 that are electrically connected to conductors 38 and 40 for a first circuit switch 64 are positioned between side panel 82 and the confronting wall segments 94 associated therewith, substantially against the inner surface of base 80. Conductors 38 and 40 are disposed along the inner surface of base 80 on opposite sides. The second pair of contacts 68 electrically connected to conductors 42 and 44 for second circuit switch 66 is positioned between side panel 84 and the confronting wall segments 94 associated therewith. Locating features 102 on base 80 retain contacts 68 for second switch 66 at a greater distance from base 80 than contacts 68 for first switch 64, and second conductors 42, 44 are stacked on conductors 38 and 40, respectively.

Rotor 100 is installed between barrier segments 96, with end edge 190 thereof disposed in channel 112 and first and second cam surfaces 180, 182 aligned with first and second switches 64, 66, respectively. The completed assembly of switch housing part 60, first and second switches 64, 66 disposed therein connected to conductors 38, 40, 42 and 44, with rotor 100 positioned therein is illustrated in FIG. 9. By replacing rotor 100 with a rotor of different outer configuration the switching functions and relationships between switch 64 and switch 66 can be changed.

One of the advantages of a preferred embodiment of the present invention is that the completed assembly of switch housing part 60 with switches 64, 66 therein can be produced for use with a variety of different rotors 100 for different switching operations and with a variety of different mounting parts 62 for connection to different types of gas valves in different frameworks and structures.

With the appropriate rotor 100 inserted therein, switch assembly 20 is completed by placing mounting part 62 over switch housing part 60. Complementary engagement features that are non-symmetrical, such as a single latch loop 104 on one side of switch housing part 60 and two latch loops 106, 108 on an opposite side of switch housing part 60 for association with one protrusion 132 on one side of mounting part 62 and two protrusions 134, 136 on an opposite side of mounting part 62, facilitate proper orientation of the parts to attach mounting part 62 only one way with respect to switch housing part 60. Accordingly, the locating features 148, 150 on the inner surface of base 120 of mounting part 62 are properly positioned for securing first and second switches 64, 66 in proper position, and for covering and securing the positions of conductors 38, 40, 42 and 44.

Multiple dual function switch assemblies 20 can be installed in similar manner at selected locations along conductors 38, 40, 42 and 44 to provide a preassembled wire harness 24 for installation in an appliance 22, such as a gas cooking range or the like, to provide electrical switch functions associated with multiple gas valves 26. Thereafter, preassembled wire harness 24 can be installed in the appliance 22 by inserting dual function switch assemblies 20, with aligned apertures 110, 122 and opening 186, over valve stems 188 of gas valves 26. Conductors 38, 40, 42 and 44 are connected to the additional circuit components, including, for example, electronic ignition modules, indicator lights, audible buzzers, etc.

For connection to different types of valves and/or different types of frames, similar switch housing parts 60 having switches 64 and 66 can be connected to different types and arrangements for mounting part 62. Various different rotors can be associated therewith for operating first and second switches 64, 66 in different sequences.

Variations and modifications of the foregoing are within the scope of the present invention. It is understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention. The claims are to be construed to include alternative embodiments to the extent permitted by the prior art.

Various features of the invention are set forth in the following claims.

What is claimed is:

1. A multifunction switch assembly comprising:

a switch housing part having a base;

first and second switches disposed in said switch housing part at different relative elevations with respect to said base;

a switch actuating rotor having first and second peripheral profiles aligned with said first and second switches, respectively; and a mounting part overlying said first and second switches and having an outward feature for attaching said switch assembly in an installation, said switch mounting part and said switch housing part adapted for engagement one with the other;

wherein said rotor has a notch extending along an axial direction of the rotor, and said switch housing part has a post extending from the base along the axial direction of the rotor and being received in said notch for inhibiting unintended rotation of said rotor relative to said switch housing part.

2. The switch assembly of claim 1, said first and second switches comprising pairs of interchangeable resilient contacts.

3. The switch assembly of claim 2, each said resilient contact having:

an elongated, flat body with opposite ends, and an end portion extending directly from one of the opposite ends of the elongated flat body and obliquely towards the other resilient contact in the same pair of interchangeable resilient contacts.

4. The switch assembly of claim 3, each said contact having an axially oriented slot with an end opening at the other of the opposite ends of the elongated flat body for engaging an electrical conductor.

5. The switch assembly of claim 1, said the post received in the notch inhibits the unintended rotation of said rotor relative to said switch housing part both clockwise and counter-clockwise.

6. The switch assembly of claim 1, said switch housing part and said mounting part having complementary engagement features for securing one to the other.

7. The switch assembly of claim 6, said engagement features being non-symmetrical.

8. The switch assembly of claim 7, said engagement features including a loop on one of said switch housing part and said mounting part and a protrusion on the other of said switch housing part and said mounting part, said protrusion being received in said loop.

9. A switch assembly, comprising:

a first unitary molded body defining a first switch part containing contacts therein for first and second switches and a rotor for actuating said switches, said rotor having first and second annular profile portions aligned with said first and second switches respectively, and;

a second unitary molded body defining a second switch part overlying said first switch part and including connecting features for mounting said switch assembly in an installation; wherein each of said first and second switches has a pair of interchangeable switch contacts;

each of said switch contacts has:

an elongated body with opposite ends, and an end portion extending directly from one of the opposite ends of the elongated body and obliquely towards the other switch contact in the same pair of interchangeable switch contacts, for providing wiping contact against the other switch contact;

each of said switch contacts has an axially oriented and end opening slot at the other of the opposite ends of the elongated body for electrically engaging an electrical conductor; and each said elongated body has dimples along a length thereof for improving rigidity.

10. The switch assembly of claim 9, said first and second switch parts defining an axially aligned opening therethrough.

11. The switch assembly of claim 9, at least one of said first and second switch parts having strain relief ridges along a path for a conductor extending therethrough.

12. The switch assembly of claim 9, said first and second switch parts and said rotor defining an open passage through said switch assembly.

13. The switch assembly of claim 9, said first switch part having a base defining an aperture and a rim on an outer surface of said base surrounding said aperture.

14. A wire harness, comprising:

first, second, third and fourth conductors;

a switch assembly having a first switch therein electrically connected to said first and second conductors, and a second switch therein electrically connected to said third and fourth conductors; and a rotor disposed between said first and second switches and including first and second circumferential profiles aligned with said first and second switches, respectively;

wherein said third and fourth conductors are stacked on said first and second conductors, respectively:

said conductors extend from a first side of the rotor to a second, opposite side of the rotor; and the first switch and the second switch are arranged on said first side and second side of the rotor, respectively.

15. The wire harness of claim 14, each of said first and second switches having a pair of switch contacts, and all of said switch contacts of said first and second switches being interchangeable one with another.

16. The wire harness of claim 15, each said contact having an elongated body, an inclined end at one end of said body and an insulation displacing contact slot at an opposite end of said body;

wherein the inclined end extends directly from said one end of the elongated body and obliquely towards the other switch contact in the same pair of switch contacts; and wherein an entirety of each said contact, except for said inclined end, is located in a single plane.

17. The wire harness of claim 16, said insulation displacing contact slot being axially oriented in said body and have a laterally oriented opening at said opposite end.

18. The wire harness of claim 14, including two said switch assemblies each having two switches therein.

19. The wire harness of claim 14, said switch assembly having a switch housing part containing said first and second switches and said rotor; and a mounting part connected to said switch housing part and including a connecting fixture for attaching said switch assembly within an appliance.

20. The wire harness of claim 14, said third and fourth conductors being contactable with said first and second conductors, respectively, between said switches.

* * * * *